United States Patent [19]

Morris, Sr.

[11] Patent Number: 4,732,288

[45] Date of Patent: Mar. 22, 1988

[54] CHILD-RESISTANT MOLDED PLASTIC CONTAINER LID FOR OPEN HEAD CONTAINERS

[76] Inventor: Glenn H. Morris, Sr., 1192 Cumberland Rd., Chattanooga, Tenn. 37419

[21] Appl. No.: 82,230

[22] Filed: Aug. 6, 1987

[51] Int. Cl.[4] ..... B65D 55/02; B65D 41/04

[52] U.S. Cl. ..... 215/214; 215/216; 220/323

[58] Field of Search ..... 215/214, 216, 217; 220/323

[56] References Cited

U.S. PATENT DOCUMENTS

| | | | |
|---|---|---|---|
| 3,612,323 | 10/1971 | Malick | 215/214 |
| 4,053,077 | 10/1977 | DeFelice | 215/217 |
| 4,114,779 | 9/1978 | Stoll | 220/323 X |
| 4,281,778 | 8/1981 | Stull | 215/214 X |
| 4,298,132 | 11/1981 | Galer | 215/217 X |
| 4,410,097 | 10/1983 | Kusz | 215/214 |

*Primary Examiner*—Stephen Marcus
*Assistant Examiner*—Nova Stucker
*Attorney, Agent, or Firm*—Brady, O'Boyle & Gates

[57] ABSTRACT

A child-resistant molded plastic container lid for an open head container having resiliently biased locking members cooperating with locking teeth provided on the container.

14 Claims, 9 Drawing Figures

FIG. 1
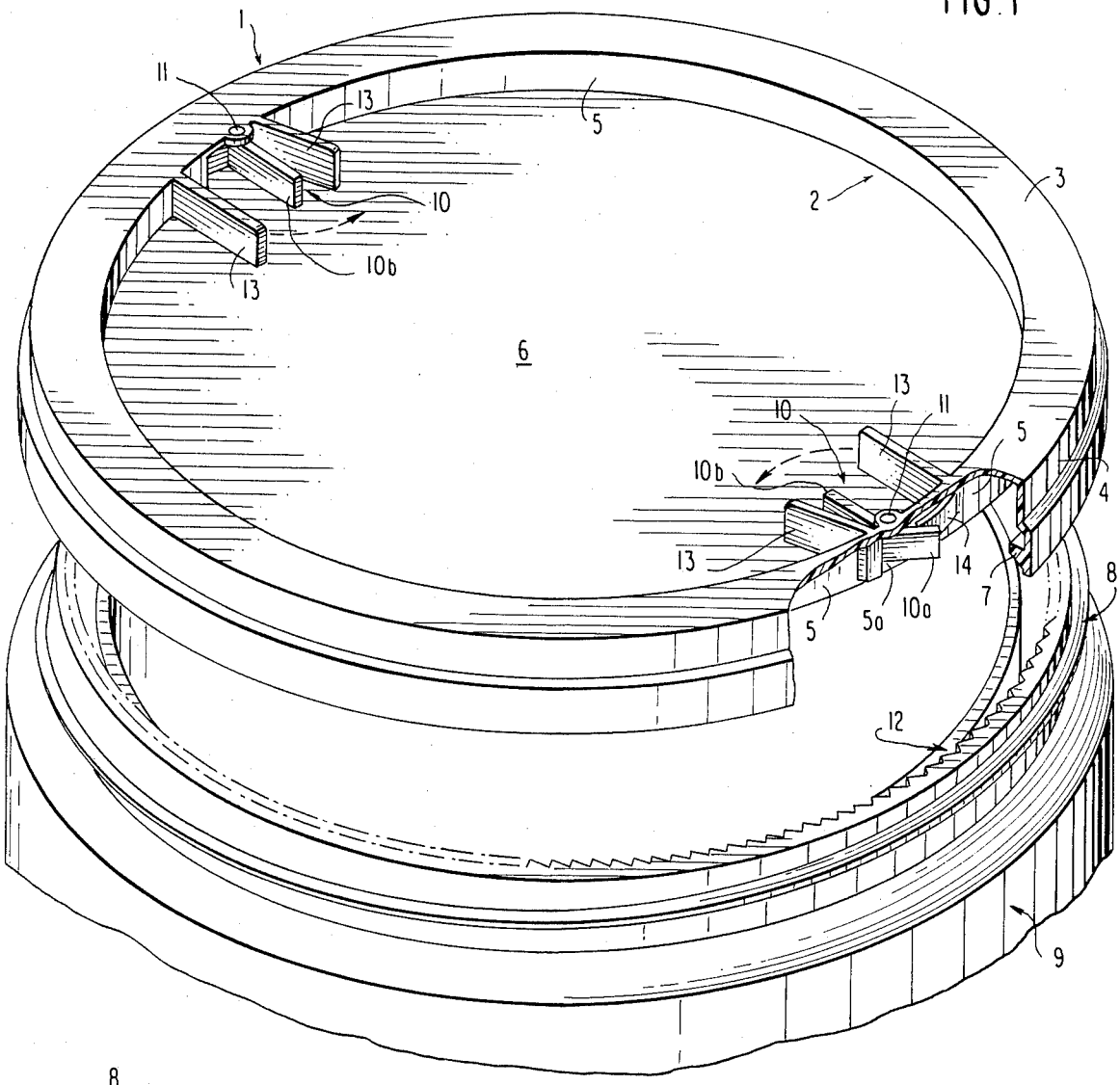
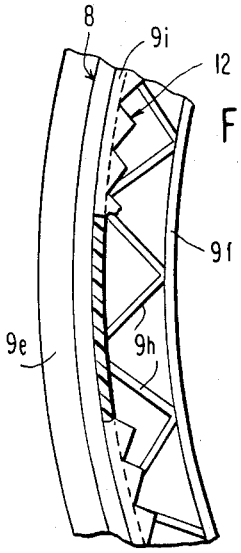
FIG. 8
FIG. 9
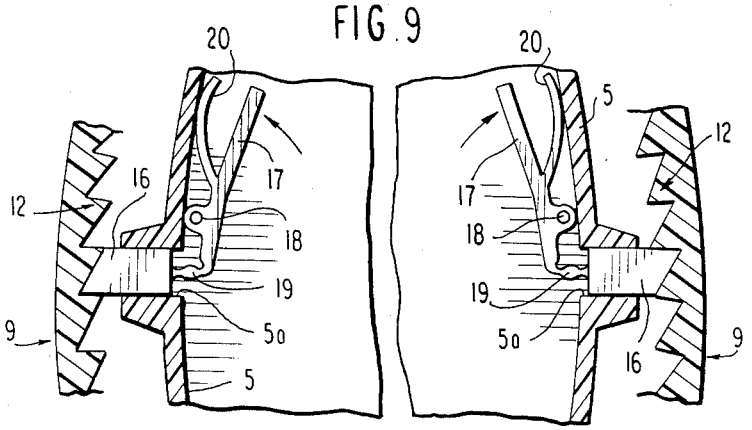

1
3
3a
3b
4
6
6a
7
8a
8b
9
9a
9b
9c
9d
9e
9f
9g
9h
9i
10a
10b
11
12
13
14
15
8.

CHILD-RESISTANT MOLDED PLASTIC CONTAINER LID FOR OPEN HEAD CONTAINERS

BACKGROUND OF THE INVENTION

Large thick-walled plastic containers of the order of two and one-half, five and six gallon sizes, and even larger, are commonly employed for packaging and transporting various liquid and solid material, such as foods, detergents, chemicals and the like, which may be corrosive and/or poisonous.

These containers are usually open head containers having molded plastic container lids including a skirt portion having inwardly extending ribs engaging an outwardly extending lip on the top edge of the container. A sealing ring is also carried by the lid and engages the top edge of the container when the lid is in place on the container. To open these containers, it is necessary to pry the skirt portion of the lid away from the ribs on the container, and to close the container it is necessary to push or force the lid onto the container so that the ribs on the lid will once again snappingly engage the lip on the container. Often times, once the lid is removed from the container, it is not replaced on the container in a sealing manner but merely placed on the top edge of the container, thereby rendering the contents of the container easily accessible to unauthorized persons, more particularly, children.

After considerable research and experimentation, applicant has extended his expertise in child-proof bottle caps to open head containers having molded plastic container lids, wherein a threaded connection is provided between the container and the lid or closure and the lid is provided with a pair of diametrically disposed resiliently biased locking members, pivotally connected to the closure, which cooperate with locking teeth on the container. The ratcheting action of the locking members and teeth allow the closure to be threaded or screwed onto the container and prevent rotation of the closure in the opposite direction to remove the closure. To remove the closure, the user grasps both resiliently biased locking members and pivots them in a direction to release the locking members from the teeth while turning the closure in a direction to remove it from the container.

BRIEF DESCRIPTION OF THE DRAWINGS

FIG. 1 is a perspective view of the container closure of the present invention prior to assembly on an open head container;

FIG. 8 is a fragmentary, top plan view, taken along line 8—8 of FIG. 5; and

FIG. 9 is a fragmentary, sectional, top plan view showing another embodiment of the resiliently biased locking members on the container closure.

DESCRIPTION OF THE PREFERRED EMBODIMENT

Figure 2:
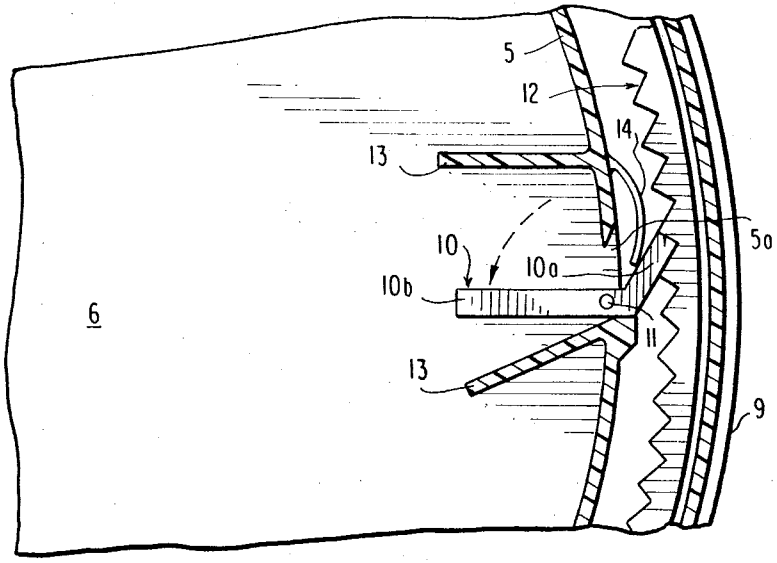
FIG. 2 is an enlarged fragmentary, sectional, top plan view showing the resiliently biased locking member on the closure engaging the locking teeth on the container.

Referring to the drawings and more particularly to FIG. 1, the container closure 1 of the present invention comprises an inverted U-shaped annular rim 2 having a top wall 3, an outer wall 4 forming a skirt portion, and an inner wall 5 integrally connected at its lower end to a flat closure wall 6, whereby the flat closure wall 6 is recessed within the area bounded by the inner periphery of the annular rim 2. A buttress thread 7 is provided on the inner surface of the skirt portion 4 and cooperates with a similar interrupted thread 8 on the outer peripheral surface of the upper end portion of an open head container 9 for threadably securing the closure 1 to the container.

A pair of diametrically disposed resiliently biased locking members 10 are pivotally connected as at 11 to the top wall 3 of the closure rim 2. Each locking member is in the form of a bell crank lever having one arm 10*a* extending through an opening or slot 5*a* provided in the rim inner wall 5 and adapted to engage locking teeth 12 provided on the inner peripheral surface of the upper end portion of the open head container 9. The other arm 10*b* of the locking member forms a handle to be grasped by the user and pivoted in the direction of the arrows to release the arm 10*a* from the locking teeth 12. Each arm 10*b* of the locking member 10 is positioned between a pair of inwardly extending gusset walls 13 integrally connected to the inner wall 5 of the rim 2 and the flat closure wall 6 to thereby protect the locking member arm 10*b* from any damage which might be caused when the closed containers are stacked one upon the other.

Figure 3:
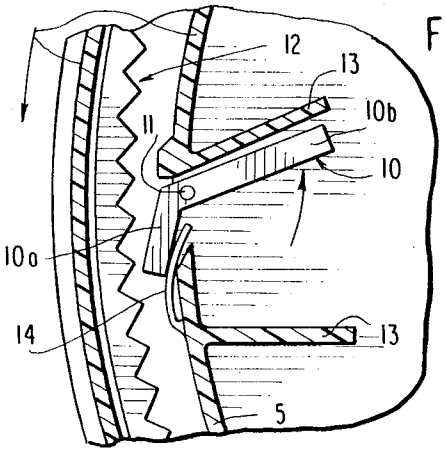
FIG. 3 is a fragmentary, sectional top plan view showing one of the locking members of FIG. 2 pivoted to the released position away from the locking teeth.

As will be seen in FIG. 2, the resilient biasing of the arms 10*a* into engagement with the container teeth 12 is provided by a spring member 14 having one end integrally connected to the outer surface of the rim inner wall 5, and the opposite end abutting the arm 10*a*. When the locking member 10 is pivoted to the released position, the spring member 14 is moved to the compressed position as shown in FIG. 3.

Figure 4:
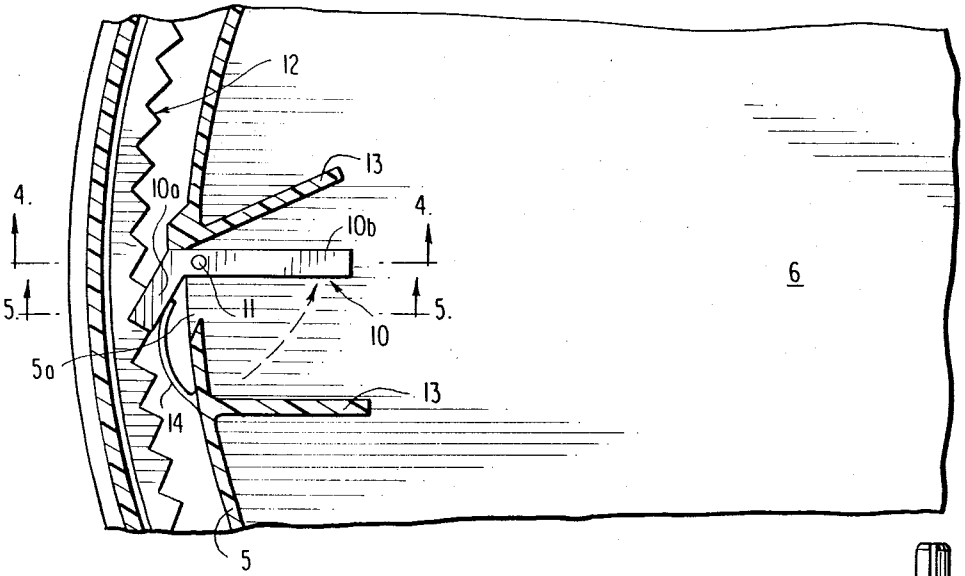
FIG. 4 is an enlarged, exploded side elevational view, partly in section, taken substantially along line 4—4 of FIG. 2 and showing the assembly of a locking member onto the closure.
Figure 4:
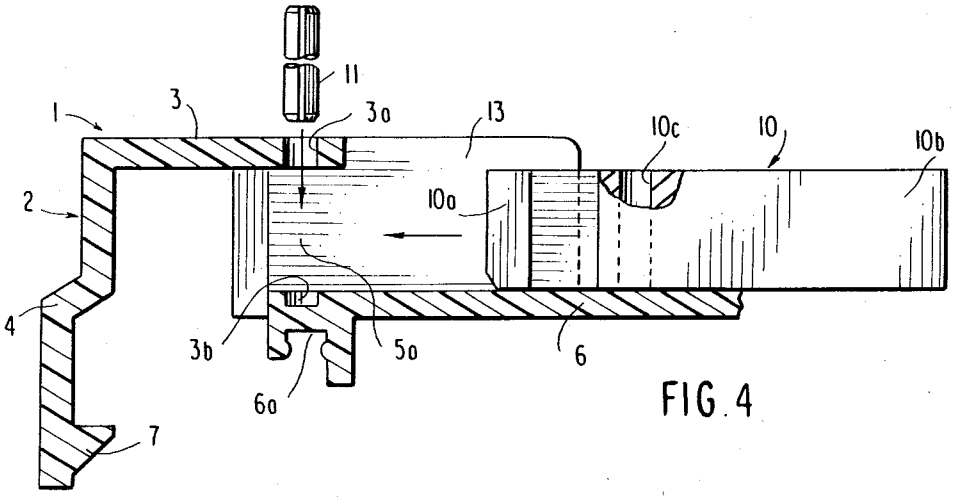

FIG. 4 illustrates the pivotal connection of each locking member 10 to the container closure 1, wherein the pivot pin 11 is adapted to extend through an opening 3*a* provided in the rim top wall 3 and into a bore 10*c* provided in the arm 10*b* when the opening 3*a* and 10*c* are aligned, and into a socket 3*b* in wall 6.

Figures 5, 6, 7:
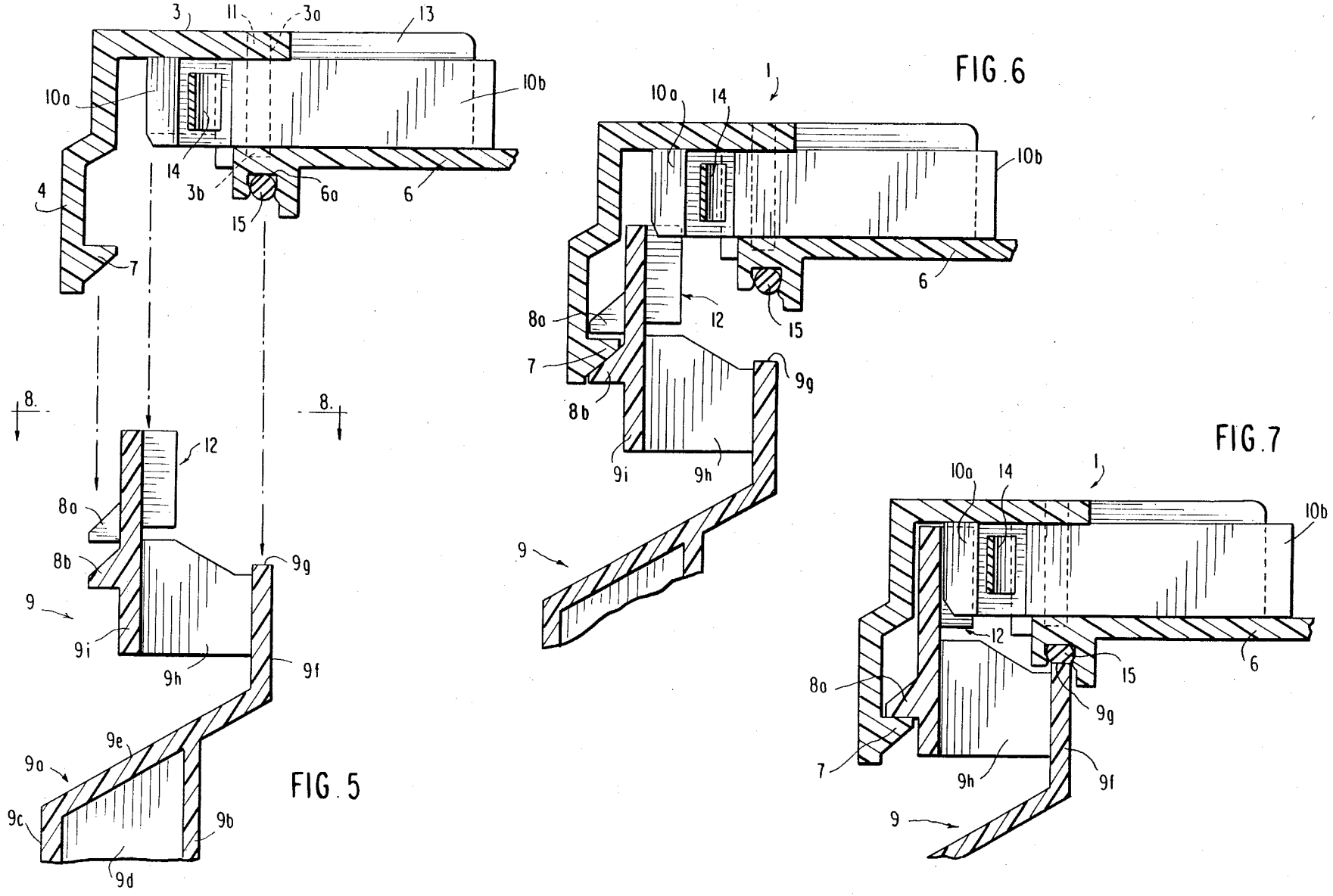
FIG. 5 is an enlarged, fragmentary, exploded side elevational view, partly in section, taken substantially along line 5—5 of FIG. 2 showing the closure of the present invention positioned prior to assembly on the container as shown in FIG. 1.
FIG. 6 is a fragmentary, side elevational view of the closure, as shown in FIG. 5, showing the position of the closure on the open top container just prior to tightening the closure thereon.
FIG. 7 is a fragmentary, side elevational view of the closure, as shown in FIG. 6, showing the closure fully assembled on the open top container.

As will be seen in FIGS. 5 and 8, the open head container 9, to which the lid of the present invention is to be applied, comprises a main body portion 9*a* of double-walled construction having an inner wall 9*b* and an outer wall 9*c* interconnected by reinforcing web members 9*d*. The upper end of the container main body portion 9*a* is provided with an inwardly and upwardly inclined wall 9*e* terminating in an axially extending wall 9*f*. The upper edge 9*g* of the wall 9*f* is adapted to sealingly engage an annular seal 15 mounted within a depending groove 6a integrally connected to the bottom surface of the closure wall 6.

The outer surface of axially extending wall 9f is provided with reinforcing web members 9h extending outwardly therefrom and integrally connected to a collar 9i having interrupted thread portions 8a, 8b integrally formed on the outer surface thereof and the teeth 12 formed on the inner surface thereof.

Referring to FIG. 6, it will be seen that the construction and arrangement of threads 7, 8a, 8b, locking member arms 10a and teeth 12 are such that when the closure 1 is initally threaded onto the container, the thread 7 on the closure engages thread 8b, and the locking member arm 10a also partially engage the teeth 12, to thereby prevent removal of the closure 1 from the container 9 without activating the locking members 10. Further threading of the closure 1 onto the container 9, as shown in FIG. 7, results in thread 7 on the closure 1 engaging the thread 8a on the container 9, and the locking arms 10a fully engaging the teeth 12, while the upper edge 9g of the container engages the annular seal 15, whereby the closure 1 is sealingly secured to the container 9.

While the closure 1 of the present invention has been described as having the bell-crank type locking members 10, FIG. 9 illustrates another embodiment of the locking members wherein a pawl 16 is slidably mounted in the opening 5a provided in the rim inner wall 5 and adapted to engage the container teeth 12. A lever 17 is pivotally connected to the top wall 3 of the rim as at 18. One end of the lever 17 is connected to the pawl as at 19 on one side of the pivot connection 18, and the portion of the lever 17 on the opposite side of the pivot connection 18 is provided with a spring member 20 having one end integrally connected to the lever 17 and the opposite end engaging the inner surface of the rim inner wall 5, whereby the pawls 16 are biased into engagement with the teeth 12, to thereby lock the closure 1 on the container. To remove the container, the user grasps the levers 17 and pivots them in a direction of the arrows, to thereby compress the spring members 12, whereby the pawls 16 are slid radially inwardly away from engagement with the teeth 12. While holding the pawls in the released position, the user turns the closure 1 to remove it from the container 9.

From the above description, it will be readily apparent to those skilled in the art that the present invention provides a child-resistant feature to open head containers having molded plastic container lids, and while the use of a pair of diametrically disposed locking members 10 are provided on the lid to enhance the child-proofness of the closure, since most children would not have the dexterity to manipulate both locking members while turning the lid 1, in some instances the lid might be provided with only one locking member.

While the gusset walls 13, FIG. 1, are provided to protect the locking members 10 from any damage caused by axial forces resulting in stacking of the containers one upon the other, damage by radial forces resulting from either rolling the containers on the ground or arranging them in side-by-side abutting engagement is prevented by constructing the closure 1, and its components, together with the collar 9i, and its attached components, to have a smaller diameter than the diameter of the container, as shown in FIGS. 5 and 6. By this construction and arrangement, any radial forces will be absorbed by the container wall 9b, 9c, 9d.

In either form of the locking members shown at 10 and 17 it is to be understood that the respective spring members 14 and 20 can be connected therewith as shown, or can be reversed. That is arm 10b of locking member 10 can have a spring member connected thereto similar to spring member 20 in FIG. 9, in lieu of spring member 14, and in FIG. 9 a spring member similar to spring member 14 can be connected to the inner side of inner wall 5 to engage lever 17 and bias it away from wall 5, in lieu of spring member 20 being integral with lever 17.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. In combination; a child-resistant molded plastic container lid and an open head container, said lid having an annular inverted U-shaped rim containing threaded portions and configured to fit over and receive the upper peripheral edge of said container, said container having threaded portions about its outer upper periphery for mating with said threaded portions of said lid, the improvement comprising, locking teeth provided on the inner peripheral surface of the upper end portion of the container, and resiliently biased locking means mounted on said lid engaging said teeth when said lid is threaded down upon said container to a closed position, to thereby prevent rotation of the lid in the opposite direction to an open position by a child, whereby the container and lid are child-resistant when closed.

2. The apparatus according to claim 1, wherein the locking means comprises a lever pivotally connected to the upper wall of the rim, an opening provided in the inner wall of said rim, and a locking member extending through said opening and engaging said teeth.

3. The apparatus according to claim 2, wherein the lever is in the form of a bell crank lever, one arm of said bell crank lever being said locking member, the other arm of said bell crank lever providing a handle adapted to be manually pivoted in a direction to release the locking member from said teeth.

4. The apparatus according to claim 3, wherein a spring member is mounted between the outer surface of the rim inner wall and the locking member for biasing the locking member into engagement with said teeth.

5. The apparatus according to claim 2, wherein the locking member comprises a pawl slidably mounted in said rim opening and connected to one end of said lever.

6. The apparatus according to claim 5, wherein a spring member is mounted between the lever and the inner surface of the rim inner wall.

7. The apparatus according to claim 2, wherein a flat closure wall is integrally connected to the lower end of the inner wall of said inverted U-shaped rim, whereby the flat closure wall is recessed within the area bounded by the inner periphery of the annular rim, and a pair of spaced, inwardly extending gusset walls integrally connected to the inner wall of the rim and the flat closure wall, said locking lever being positioned in the space between said gusset walls to thereby protect the locking lever from any damage which might be caused when the closed containers are stacked one upon the other.

8. The apparatus according to claim 2, wherein a pair of levers are pivotally connected to the lid rim, the associated locking members extending through respective openings provided in the inner wall of the rim.

9. The apparatus according to claim 8, wherein the pair of levers are diametrically disposed on the lid, whereby both levers have to be actuated to move the locking members to the released position while simultaneously rotating the lid to the open position.

10. The apparatus according to claim 1, in which said inner peripheral surface on which said locking teeth are connected is on a collar, and members connecting said collar in an outwardly spaced direction from said upper peripheral edge of said container.

11. The apparatus according to claim 10, wherein said collar has an outer peripheral surface, and said threaded portions of said container connected on said outer peripheral surface.

12. The apparatus according to claim 10, in which said members comprise vertical web members extending between said collar and the upper end portion of the container carrying said upper peripheral edge.

13. The apparatus according to claim 11, in which said locking teeth extend above said threaded portions on said collar.

14. The apparatus according to claim 10, and a flat closure wall on said lid integrally connected to the lower end of the inner wall of the inverted U-shaped rim, seal means depending from and extending around the periphery of said flat closure wall and adapted to sealing engage said upper peripheral edge of said container when the container is closed by said lid, and said seal means on said lid spaced inwardly from said collar on said container.

* * * * *